US006532610B1

(12) United States Patent
Calfas et al.

(10) Patent No.: US 6,532,610 B1
(45) Date of Patent: Mar. 18, 2003

(54) TRANSITIONAL SUPPORT FOR PHYSICALLY CHALLENGED PERSONS

(76) Inventors: William Calfas, 836 Toulon Dr., Pacific Palisades, CA (US) 90272; Karin A. Calfas, 836 Toulon Dr., Pacific Palisades, CA (US) 90272

( * ) Notice: Subject to any disclaimer, the term of this patent is extended or adjusted under 35 U.S.C. 154(b) by 0 days.

(21) Appl. No.: 10/217,385

(22) Filed: Aug. 12, 2002

(51) Int. Cl.[7] ..... A61G 7/10

(52) U.S. Cl. ..... 5/626; 5/627; 5/89.1; 5/81.1 T; 294/140; 128/870

(58) Field of Search ..... 5/81.1 R, 81.1 T, 5/81.1 HS, 89.1, 625, 626, 627; 294/140; 128/870

(56) References Cited

U.S. PATENT DOCUMENTS 675,409 A * 6/1901 Pettee ..... 5/627
1,207,750 A * 12/1916 Caspar ..... 5/627
1,281,385 A * 10/1918 Johnson ..... 5/625
1,849,864 A * 3/1932 Gwin ..... 294/140
2,379,365 A * 6/1945 Levison ..... 5/627
3,271,796 A * 9/1966 Dillman ..... 5/625
3,859,677 A * 1/1975 Nordwig ..... 5/89.1
5,317,770 A * 6/1994 Sakurai ..... 5/625
5,515,549 A * 5/1996 Wang ..... 5/625
6,185,761 B1 2/2001 Chapman et al.

FOREIGN PATENT DOCUMENTS

WO WO 89/07430 * 8/1989 ..... 5/625

* cited by examiner

*Primary Examiner*—Michael F. Trettel
(74) *Attorney, Agent, or Firm*—Donald D. Mon

(57) ABSTRACT

Transitional support for physically challenged persons. The support has a flexible inelastic base sheet with flexible inelastic loops at parallel edges to accommodate removable rigid poles. Pull straps on the sheet may be included to pull a person along the floor. To provide for a sitting support, a back sheet can be provided to join with the folded base sheet as a back restraint.

6 Claims, 3 Drawing Sheets

TRANSITIONAL SUPPORT FOR PHYSICALLY CHALLENGED PERSONS

FIELD OF THE INVENTION

Transitional support for physically challenged persons who require assistance in moving from one position or location to another, for example rising or escaping from a fall, or transitioning from a wheelchair to an examination table, or an X-ray table, and for access and evacuation to and from places where barriers are such that they cannot climb them or a wheelchair cannot negotiate.

BACKGROUND OF THE INVENTION

The term "transition" is used herein to mean the movement of a person from one position or location to another.

A wide array of events, disease, and deterioration face persons of all ages and physical conditions. Prominent among them are those which impair or prevent a person's motor functions, including unconsciousness and the inability to respond to a need to move. These involve the simplest yet most important physical capabilities—the transitional abilities to get up from the floor, stand up, sit down, move from one seat to another, or to move from a seat to a table such as an examination table or an X-ray table.

The incapacity to negotiate any of these movements can and does cause severe reduction in the quality of one's life. Recent litigation under the Americans With Disabilities Act complains of the reluctance and difficulties of transitioning from a wheelchair to an examination table or an X-ray table, for example. In one such case, the wheelchair-bound patient had a physical examination while seated (with bed sores concealed from view), and had never had them directly examined, and also had never received a gynecological examination. The physician simply had no means other than manually lifting to lift and transfer the patient, and dealt with him seated in the chair.

A visit to a nursing home will show many such and related problems. Prominent among them are falls. When a person falls, somehow he or she must be lifted off of the floor. Such a situation also occurs all too frequently in the home. Lifting the person by one or two people involves serious risk, not only to the elderly, but also to the persons who must pick them up. There is a substantial reluctance by attendants to pick people up because among other things, the risks of injury to themselves are quite high.

As an example, ribs can readily be broken. This situation is even riskier when the fall is in a limited area such as a small bathroom. The task of removing the person from the area is complicated by the large sizes of two emergency personnel as well as of the fallen person, who then must be carried through a narrow door.

A common technique to raise a fallen person, or manually to transition one, is to grip the person from the rear, under the arms, and hold the person against his own weight. This means compressing the person at great risk where their bones are weak. This can cause great pain, and the response to such pain is a cry, which is unsettling to the assistant. Severe bruising often occurs as well as broken bones, even with the most considerate handling.

Beyond the emotional and physical risk to the fallen person are the accompanying risks and damages to the helpers. Even a light person weighing 150 pounds means a load on the assistant of 75 pounds, exerted in a most difficult posture. Heavier persons presents loads which readily exceed OSHA standards for weights to be lifted.

As a consequence of these and other related risks, workers compensation rates in convalescent hospitals are very high. In fact, the incidence of occupational and illness cases per 100 full-time workers (in 1994) in nursing homes was 16.8, compared to 8.4 in industry generally.

This helps to explain the reluctance of nursing homes and hospital workers to lift patients manually. In fact, often there is a flat refusal to do so.

This invention provides means for access to the lifting process of more than two persons, so that a heavy weight can be distributed to the extent that the load on each attendant is within tolerable limits. Also, the means according to this invention for lifting the person enables the attendants to assume a safe and efficient posture, thereby reducing their exposure to risk.

The fear experienced by a physically challenged person being transitioned from one stable position to another is understandable, as is the embarrassment attendant upon being moved in such a manner. As to pride, a modest woman in her night gown anticipates with dread the unavoidable exposure of her body when she is moved under stringent conditions.

It is an object of this invention to provide devices useful for transitioning challenged persons from one position to another with no or at least less trauma, and providing them with continuing assurance that with these helpful devices available, much safer and agreeable transitions are there for them when they are needed.

There are other situations in which incapacities of the type described above are nearly as daunting to the challenged person as those which relate to movement of a fallen or unconscious person. These relate to physical barriers which cannot be traversed by a wheelchair, or which are beyond the capacity of a conscious and alert person to surmount. The best-known example is a few stairs. Sometimes only one stair is unsurmountable.

The limitations of the staircase are regularly attended to where a person lives, or wherever public policy prescribes that access be provided. The common remedy is a ramp. They are seen everywhere—on curbs and around stairs. The homes of challenged persons are frequently provided with ramps.

But what if the situation or arrangement is such that the installation of ramps is too seldom needed or not required by law, and therefore not provided? A particularly poignant such situation is the home of a friend. Are there are steps leading into every entry? All too often the challenged person simply does not visit. How would the person be carried up? A well-dressed and proud person is reluctant to be picked up by two persons with arms under him or her, hanging onto their shoulders, and often the clumsy orientation of the load presented by the person is beyond the lifting capability of the persons.

There is yet another. In buildings and hotels with elevators, all is well until the fire alarm sounds. Then the elevators don't work. What is the challenged person to do? It is a worrisome thought.

It is another object of this invention to provide a support for the challenged person that will hold him or her in a seated position in structures that can be lifted conveniently at the sides. The load to be lifted is stabilized and well-distributed. The person can readily be placed in the device of this invention and then be transitioned with dignity up or down stairs and past any barriers, and thereafter handily placed in a seated position on a wheelchair or article of furniture.

Thus the same device that is so useful in succoring a fallen person or transitioning a person in some facility, can enable visits to friends homes, or to be able to occupy quarters with steps which would otherwise not be available.

Attention is called to the convenience of placing the person in the seated position with the use of this invention.

BRIEF DESCRIPTION OF THE INVENTION

A support according to this invention is adaptable to be fitted to a disabled person to engage the person in a safe manner for movement with no or minimal physical risk. Also this provides rigid members which can be placed after the support is fitted, to enable the person conveniently to be lifted and moved, and to enable the load to be distributed in a convenient manner According to an optional feature of the invention, a back strap is releasably fitted between two sides of a flexible base sheet to form a chair-like structure for conveying the person while in a sitting posture.

According to another optional embodiment of this invention, the support may be provided with an extension that permits a person on it to be slid along the floor in order to be removed from a confined area.

BRIEF DESCRIPTION OF THE DRAWINGS

FIG. 8 is a plan view of a modification of the device of. FIG. 4.

DETAILED DESCRIPTION OF THE INVENTION

Figure 1:
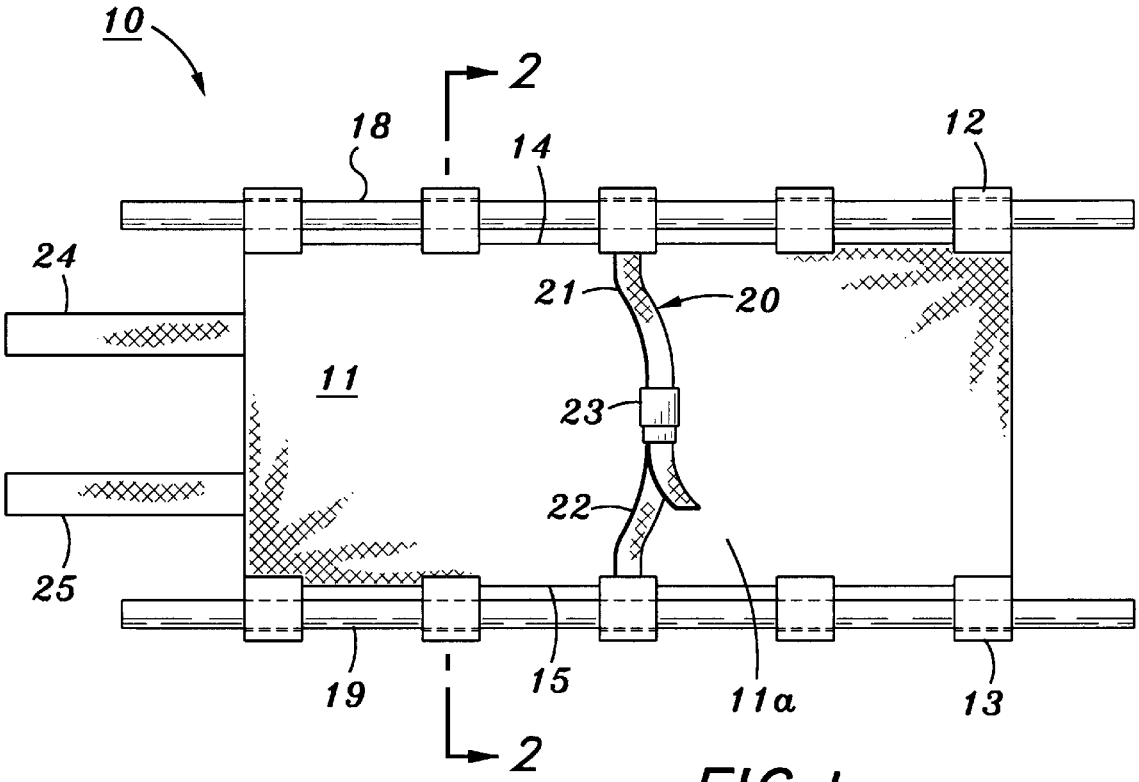
FIG. 1 is a plan view of the presently-preferred embodiment of the invention, laid flat to receive a person laid on it.

FIG. 1 shows a transitional support 10 comprising a base sheet 11 for the support of a person to be placed upon it. The sheet is made of flexible material such as a strong canvas or Naugahyde able to be bent around the person and supporting him while being lifted.

Figure 2:
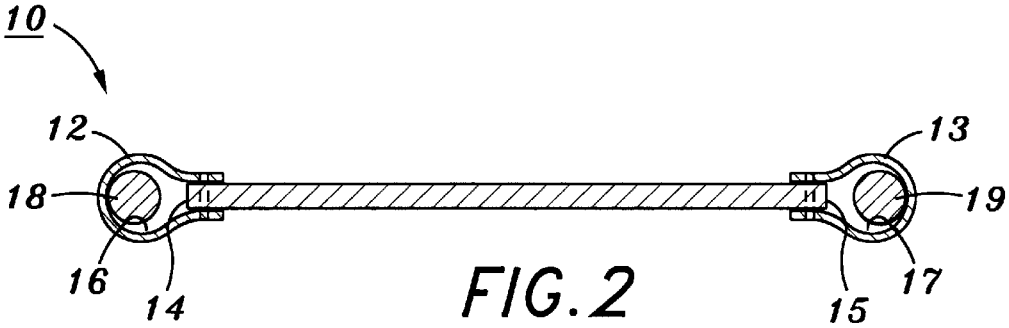
FIG. 2 is a cross-section taken at line 2—2 in FIG. 1.

A group of loops 12, 13 is provided along respective sides 14, 15 of the sheet. These loops are strong and are strongly attached to the sheet. As shown in FIG. 2, they form passages 16, 17 to receive poles 18, 19. The poles can be made in separate telescoping parts, or may be a single pole. The use of segmented poles reduces the length needed in the surrounding area to clear the poles, and facilitates inserting the poles after a person is placed on the sheet. The loops are made of strong flexible material so they can be stored flat. Notice that there are many open spaces between the loops where the attendants can grip the poles.

A restraint belt 20 is formed in two segments 21, 22, each sewed at one end to the sheet. A buckle or hook and loop fastener 23 can separably join the belt segments to restrain a person.

Pull straps 24,25 are attached to an end of the sheet. These can be used to pull the sheet, with a person on it, along the floor to extract the person from a limited area. Useful dimensions for the sheet are 72 inches long and 32 inches wide, although different dimensions may be used instead. Especially to pull a person through a narrow door, the sheet will be narrower.

In use, the poles will be removed while the sheet is pulled or placed under the fallen person. For example, the person may be rolled to one side to place part of the sheet, rolled onto that part and the other portion of the sheet pulled through. Then the person will be laying on the sheet.

Figure 3:
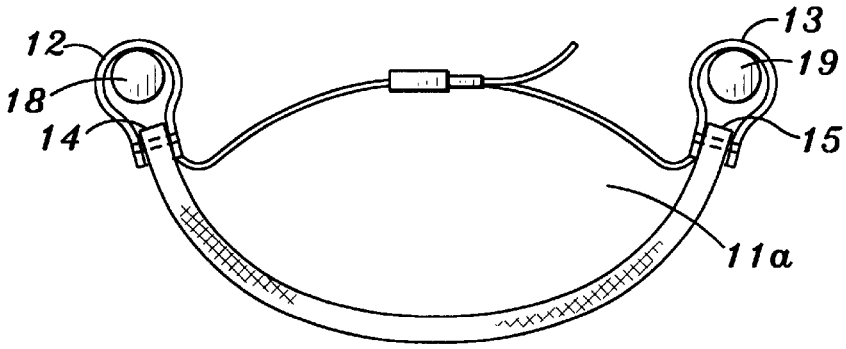
FIG. 3 shows the device of FIG. 1 lifting the person.

The loaded sheet can be pulled longitudinally by the pull straps to a place where the poles can be inserted into the loops. Then the poles can be inserted and the person can be lifted and transitioned as shown in FIG. 3.

This device can also be laid on an examination table or an X-ray table, with or without the person on it. The poles can be removed or not, and when the person is next to be moved, the poles can be installed, and the person can readily be moved. The material can be transparent to X-rays so it need not be removed when the X-rays are taken.

Figure 4:
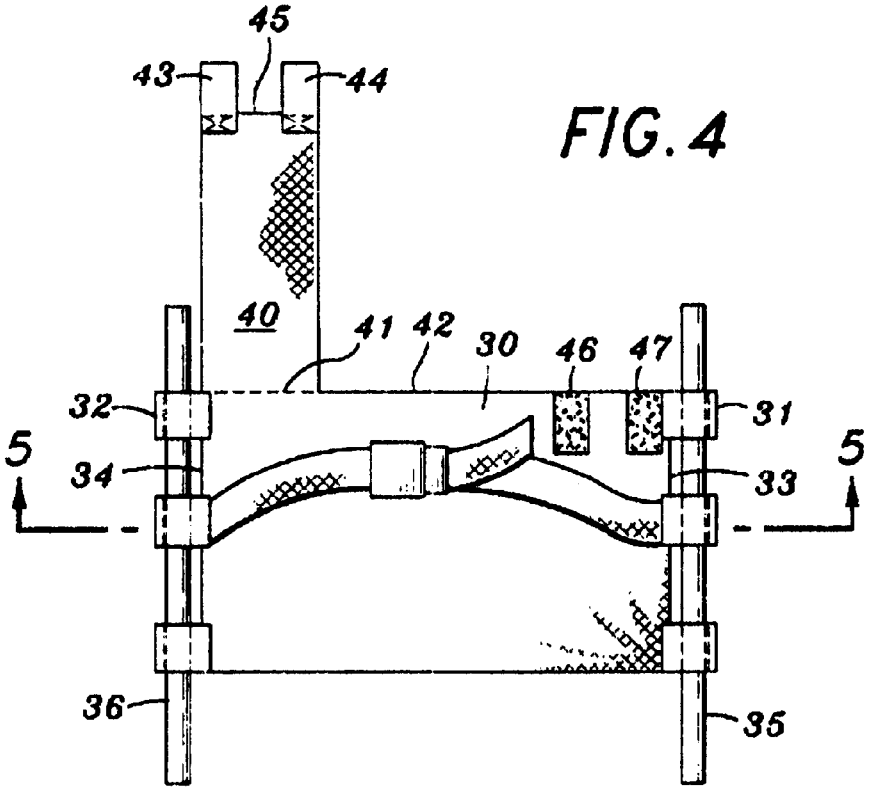
FIG. 4 is a plan view of another embodiment of the invention, laid flat.
Figure 5:
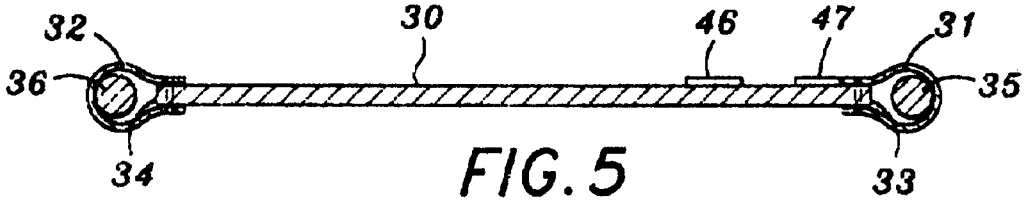
FIG. 5 is a cross-section taken at line 5—5 in FIG. 4.
Figure 6:
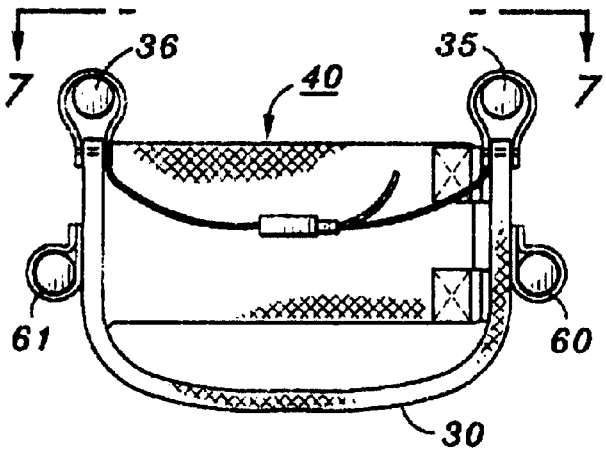
FIG. 6 is an end view of the erected configuration of the device of FIG. 4.
Figure 7:
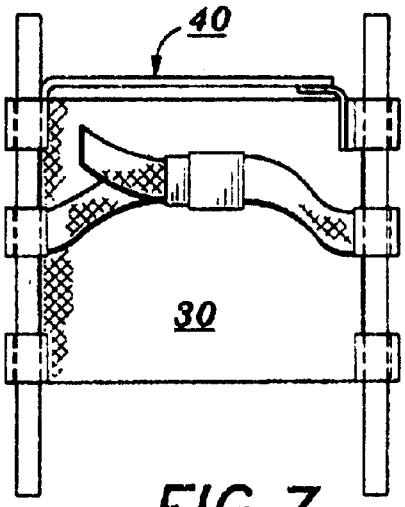
FIG. 7 is a top view of FIG. 6.

The device of FIG. 1 is primarily intended for a prone person. The device of FIG. 4 is primarily intended for a person either in a sitting posture or in a prone posture to be moved to a sitting posture, or lowered from a sitting posture to a prone posture. In whichever event, means is provided to lift and transition the-person while in a seated posture. As such, the device can readily be used in a chair, placed there along with the person, or placed there before the person is moved into the chair. Also, while seated in the device, the patient can be placed on an intermediate support such as a low table or stool, and from there lifted onto the table. This is a convenient technique for transitioning a person from a wheelchair and avoids having to contend with the arms of the wheelchair.

A base sheet 30 is preferably rectangular and made of a strong flexible inelastic material such as canvas or Naugahyde. Groups of loops 31, 32 are attached to edges 33, 34 of the base sheet. The loops are made of strong flexible inelastic material A back sheet 40 is attached at end 41 (which may be seen) to edge 42 of the base sheet. A pair of fastener portions 43, 44 are attached to the free end 45 of the back sheet. Complementary fastener portions 46,47 are attached to sheet 30 adjacent to edges 33 and 34 of the base sheet. The fastener portions may conveniently be complementary portions of hook and loop fastener material, or if preferred any other type of separable fastener.

To reduce the height to be lifted groups 60,61 of additional flexible inelastic loops are attached to the sheet, spaced below the groups 31 and 32 at the edge. This is convenient for lesser height lifts.

Figure 8:
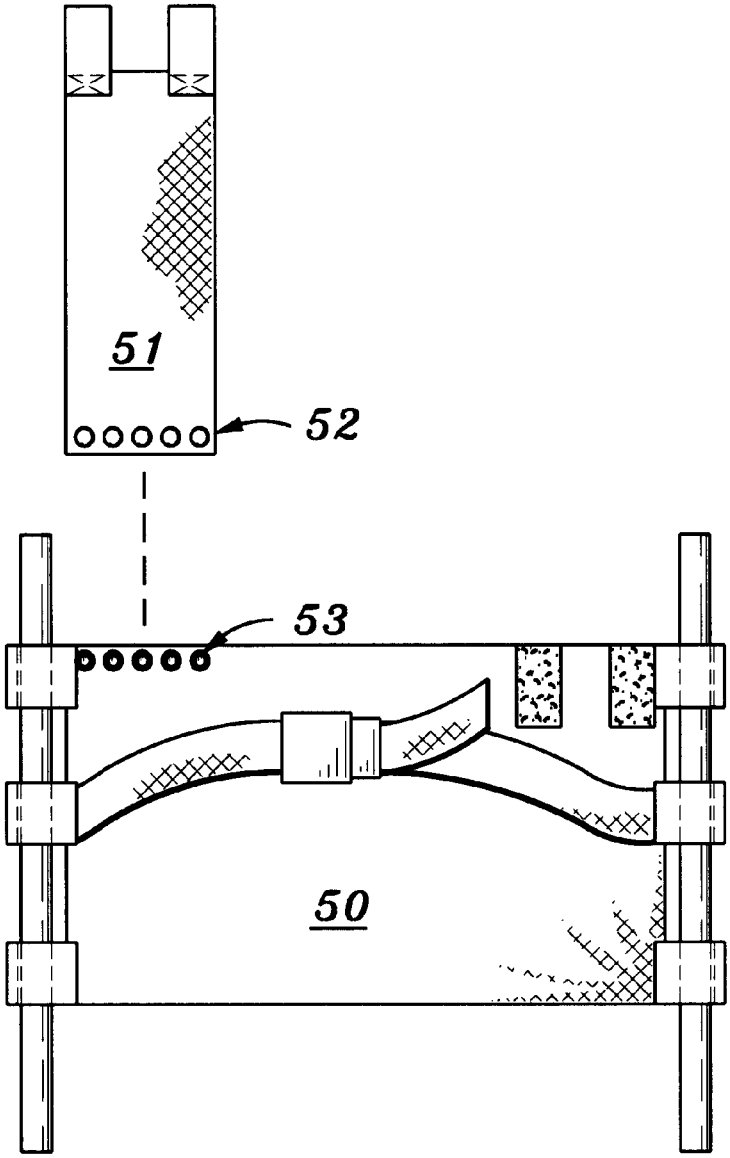

FIG. 8 illustrates that a back sheet 50 can be completely separated from the base sheet 51, and can releasably be attached to the sheet by sets 52 and 53 of separable buckles. Of course hook and loop fasteners could also be used. The configuration of FIG. 8 will be used when back support is not always necessary, in which event it becomes a shorter version of the device of FIG. 1. Suitable dimensions for the base sheet shown in FIG. 8 are 30 inches wide, 19 inches long, and for the back sheet 18 inches long and 8 inches high.

The use of the devices of FIGS. 4–8 is as follows. The base sheet will be placed under a person, preferably with the poles inserted. The person will be placed with his hips on the base sheet.

Then his upper torso is raised and the back strap brought around and its free end attached to the base sheet. This structure will, with the poles raised, support him in a seated posture. The person can now be lifted and transitioned from place to place, for example from an examination table or X-ray table to a wheelchair. The loaded device is conveniently supported and manipulated because of the structural integrity provided by the poles and by the flexible structure.

This invention thereby provides for the physically challenged person reassurance that in the event of mishap or needs for transitioning him, means exist to make it safe or safer. It offers to friends, helpers and emergency staff a means to treat this person in a gentler and more modest way. It further assures the staff that it can safely transition the person with more safety to themselves. They should thereby be readier to perform their tasks.

The convenience of transitioning a conscious person is evident from the foregoing. They can readily sit on the base sheet and have the back sheet fastened after that. This is much more convenient than having to fit into an already-configured chair shape. The convenience and dignity this device provides will encourage persons to visit places or to occupy quarters which they would often decline to use. Further, in the event of evacuation, they are much more conveniently carried, and the dread of occupying places where elevator service might be interrupted is greatly reduced or eliminated.

This invention is not to be limited by the embodiments shown in the drawings and described in the description, which are given by way of example and not of limitation, but only in accordance with the scope of the appended claims.

We claim:

1. A transitional support for a physically challenged person comprising:

a base sheet made of flexible, substantially inelastic material having dimensions of length and width, with a pair of parallel side edges and a pair of end edges connecting respective side edges;

a group of a plurality of flexible, inelastic loops attached to each of said side edges;

a restraint belt comprising a pair of segments, one attached to each of said side edges, and a separable fastener for releasably joining said segments;

a back sheet made of flexible inelastic material having a pair of opposite ends adapted to be attached to said base sheet adjacent to one of its said end edges, whereby when said base sheet is bent to a U-shape, said back sheet extends across the U-shape to form said support as a seat structure and give back support to a person seated in said bent base sheet, said back sheet being releasably attachable to said base sheet at at least one of its ends; and a pair of poles, each so proportioned as to pass through a respective group of said loops to give lifting support to the base sheet.

2. A support according to claim 1 in which one end of said back sheet is permanently attached to an end edge of said base sheet, and the other end of the back sheet and said edge of said base sheet carry complementary portions of a fastener releasably to hold said other end of the back sheet to said end edge of the base sheet.

3. A support according to claim 2 in which said pair of fastener comprises a hook and loop fastener.

4. A support according to claim 2 on which a pair of said fasteners is provided at said other end and said end edge of the base sheet.

5. A support according to claim 1 in which said back sheet is separate from said base sheet, and said base sheet and back sheet carry complementary portions of releasable fasteners to releasably attach both ends of the back sheet to the base sheet.

6. A support according to claim 1 in which an additional group of loops is attached to the base sheet spaced from said first-named groups.

* * * * *